US007389076B2

(12) United States Patent
Shin et al.

(10) Patent No.: US 7,389,076 B2
(45) Date of Patent: Jun. 17, 2008

(54) BELT TRANSFER DEVICE AND IMAGE FORMING APPARATUS HAVING THE SAME

(75) Inventors: Joong-Gwang Shin, Seongnam-si (KR); Jean-Man Sur, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 262 days.

(21) Appl. No.: 11/224,011

(22) Filed: Sep. 13, 2005

(65) Prior Publication Data

US 2006/0067744 A1 Mar. 30, 2006

(30) Foreign Application Priority Data

Sep. 24, 2004 (KR) ..... 10-2004-0076996

(51) Int. Cl.
*G03G 15/01* (2006.01)
*G03G 15/16* (2006.01)

(52) U.S. Cl. ..... 399/302; 399/313

(58) Field of Classification Search ..... 399/111, 399/121, 298, 299, 302, 313
See application file for complete search history.

(56) References Cited

U.S. PATENT DOCUMENTS 5,376,999 A 12/1994 Hwang
5,678,149 A 10/1997 Takekoshi et al.
6,324,374 B1 11/2001 Sasamoto et al.
6,862,422 B2 * 3/2005 Aoki et al. ..... 399/313
6,941,094 B2 * 9/2005 Omata et al. ..... 399/121
6,980,760 B2 * 12/2005 Okamoto et al. ..... 399/302

FOREIGN PATENT DOCUMENTS

| | | |
|---|---|---|
| JP | 58-169162 | 10/1983 |
| JP | 64-038769 | 2/1989 |
| JP | 07-168458 | 7/1995 |
| JP | 10-010876 | 1/1998 |
| JP | 2001-318507 | 11/2001 |
| KR | 10-0234322 | 9/1999 |

* cited by examiner

*Primary Examiner*—William J Royer
(74) *Attorney, Agent, or Firm*—Roylance, Abrams, Berdo & Goodman, L.L.P.

(57) ABSTRACT

A belt transfer device prevents the dragging of an image during a transfer process that transfers an image from a photosensitive body onto a transfer belt. The belt transfer device includes a transfer belt that contacts the surface of a photosensitive body, and at least one belt pressing member installed in the front and/or rear of a contact portion (that is, a transfer nip) between the transfer belt and the photosensitive body. The at least one belt pressing member extends the length of the transfer nip, thereby preventing image dragging.

16 Claims, 7 Drawing Sheets

BELT TRANSFER DEVICE AND IMAGE FORMING APPARATUS HAVING THE SAME

CROSS-REFERENCE TO RELATED APPLICATIONS

This application claims the benefit under 35 U.S.C. § 119(a) of Korean Patent Application No. 2004-76996, filed on Sep. 24, 2004, the entire content of which is hereby incorporated by reference.

BACKGROUND OF THE INVENTION

1. Field of the Invention

The present invention generally relates to an image forming apparatus. More particularly, the present invention relates to an image forming apparatus using a transfer belt for transferring an image formed on the surface of a photosensitive body (such as a photosensitive drum) to a printing medium, and a belt transfer device for use in the image forming apparatus.

2. Description of the Related Art

A typical example of an image forming apparatus that uses a transfer belt to form an image on a printing medium is a wet electrophotographic color image forming apparatus. FIG. 1 illustrates one embodiment of a conventional belt transfer device for use in a wet electrophotographic image forming apparatus.

Referring to FIG. 1, the belt transfer device 1 includes a plurality of photosensitive bodies 10 each bearing an image, and a transfer belt 20 onto which the image formed on each of the photosensitive bodies 10 is transferred.

An electrostatic latent image of printing data is formed on the surface of a photosensitive body 10 by an exposing unit (not shown), and this electrostatic latent image is developed into an image of a specific color by liquid developers supplied from a corresponding developing unit 30. For a full color image, four photosensitive bodies 10 and four developing units 30 are used to form images of four different colors. The images are transferred to the transfer belt 20 so that they are aligned.

The images formed on those four photosensitive bodies 10 are transferred and superimposed onto the transfer belt 20, and form a full color image. To make this possible, the transfer belt 20 is installed in such a manner that it follows an endless loop that makes contact with the surfaces of the respective photosensitive bodies 10. In so doing, the images formed on the surfaces of the four aligned photosensitive bodies 10 can be transferred and superimposed onto the endless loop transfer belt 20 to form a full color image. The movement of the transfer belt 20 is made possible through two rollers 21 and 23 installed on both ends. Four transfer rollers 40 are installed on the interior side of the transfer belt 20. More particularly, the four transfer rollers 40 are installed at every contact point (also called a 'transfer nip') with each photosensitive body 10, thereby facilitating the transfer of the images from the photosensitive bodies 10 to the transfer belt 20.

Unfortunately, however, the image forming apparatus using the belt transfer device 1 for transferring an image has a defect. When an image formed on the surface of the photosensitive body 10 is transferred onto the transfer belt 20 (that is, a T1 transfer process), the image is often dragged at a transfer nip (that is, the TI nip) where the photosensitive body 10 and the transfer belt 20 come into contact with each other. The underlying cause of the dragging of an image is the influence of a carrier liquid, which is a liquid developer at the TI nip, upon a liquid developer at a lower portion of the image. In other words, the liquid developer below the image is dragged into a non-image area, creating a defective image. FIG. 2 illustrates a typical example of the dragging (B) of an image during the T1 transfer process. As shown in FIG. 2, when the dragging occurs a printed image is blurred, or not sharp. Therefore, to obtain good quality printed materials, it is very important to prevent the dragging of an image during the T1 transfer process.

Accordingly, there is a need for an improved belt transfer device and an image forming apparatus having the same that minimizes dragging of an image during a transfer process.

SUMMARY OF THE INVENTION

An aspect of the present invention is to solve at least the above problems and/or disadvantages and to provide at least the advantages described below. Accordingly, an aspect of the present invention is to provide a belt transfer device for preventing the occurrence of the dragging of an image during a transfer process where the image is transferred from a photosensitive body onto a transfer belt.

It is another aspect of the present invention to provide an image forming apparatus that uses a belt transfer device to transfer an image from a photosensitive body onto a transfer belt (that is, a transfer process) without causing the dragging of an image, thereby providing high quality printed materials.

In accordance with an embodiment of the invention, a belt transfer device includes a transfer belt and at least one belt pressing member. The transfer belt follows an endless loop and contacts a photosensitive body. The at least one belt pressing member presses the transfer belt to increase the length of a transfer nip between the photosensitive body and the transfer belt.

In an exemplary embodiment, the length of the transfer nip between the photosensitive body and the transfer belt is greater than a value in which dragging of an image does not occur. In particular, the length of a transfer nip between each of the photosensitive bodies and the transfer belt is greater than a value in which the wrap angle of the transfer belt with respect to the center of the photosensitive body is 30°.

The belt transfer device may further include a transfer roller opposed to the photosensitive body. The belt pressing member may be installed in the front and/or rear of the transfer roller, respectively.

The belt pressing member may be a guide roller.

The belt pressing member may be a guide rib.

In another exemplary embodiment of the present invention, an image forming apparatus includes a plurality of photosensitive bodies, a plurality of developing units, a transfer belt, a plurality of transfer rollers, and a plurality of belt pressing members. The plurality of photosensitive bodies have electrostatic latent images formed thereon. The plurality of developing units develop the electrostatic latent images formed on the photosensitive bodies. The transfer belt follows an endless loop in contact with the photosensitive bodies, thereby allowing the images on the photosensitive bodies to be transferred onto the transfer belt. The plurality of transfer rollers are disposed opposite the photosensitive bodies on the interior side of the transfer belt. The plurality of belt pressing members are installed in front of and/or behind the transfer rollers to press the transfer belt to increase the length of a transfer nip between each of the photosensitive bodies and the transfer belt.

The photosensitive bodies and the developing units may be combined.

In addition, the length of a transfer nip between each of the photosensitive bodies and the transfer belt may be greater than a value in which the wrap angle of the transfer belt with respect to the center of the photosensitive body is 30°.

The belt pressing members may be guide rollers or guide ribs.

As described above, the length of a transfer nip between each of the photosensitive body and the transfer belt is set to be greater than a certain value where no dragging of an image occurs. Therefore, when an image formed on the surface of the photosensitive body is transferred onto the transfer belt via the transfer nip, the image is not dragged.

As such, the image forming apparatus having the belt transfer device of the present invention can provide high quality printed materials without dragged images. Again, this is made possible because the dragging of an image does not occur during a transfer process in which the image on the photosensitive body is transferred onto the transfer belt.

BRIEF DESCRIPTION OF THE DRAWINGS

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
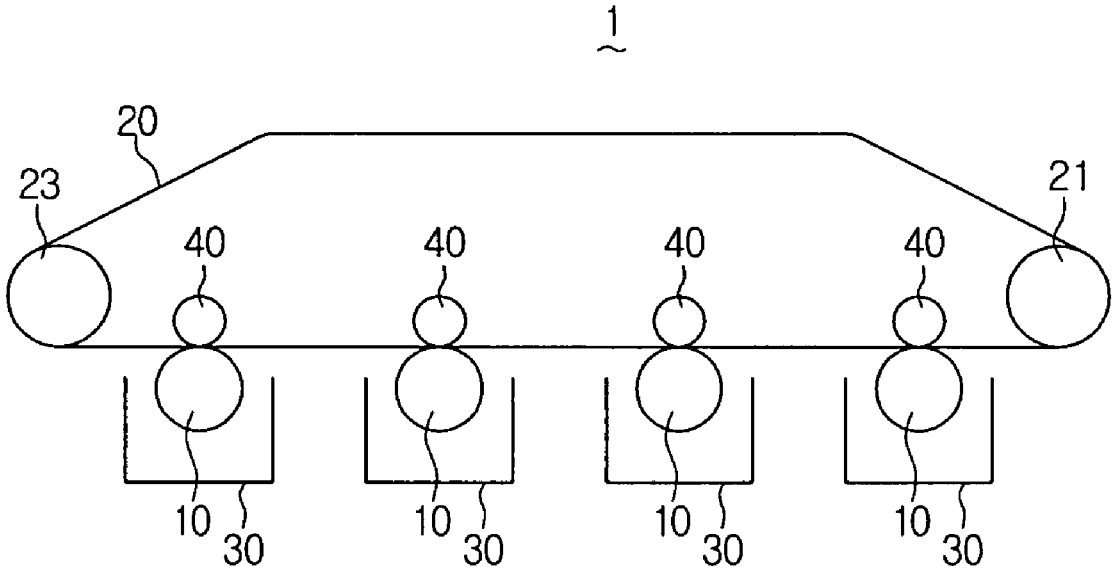
FIG. 1 (PRIOR ART)
FIG. 1 is a schematic view of a conventional art belt transfer device for use in an image forming apparatus.
Figure 2:
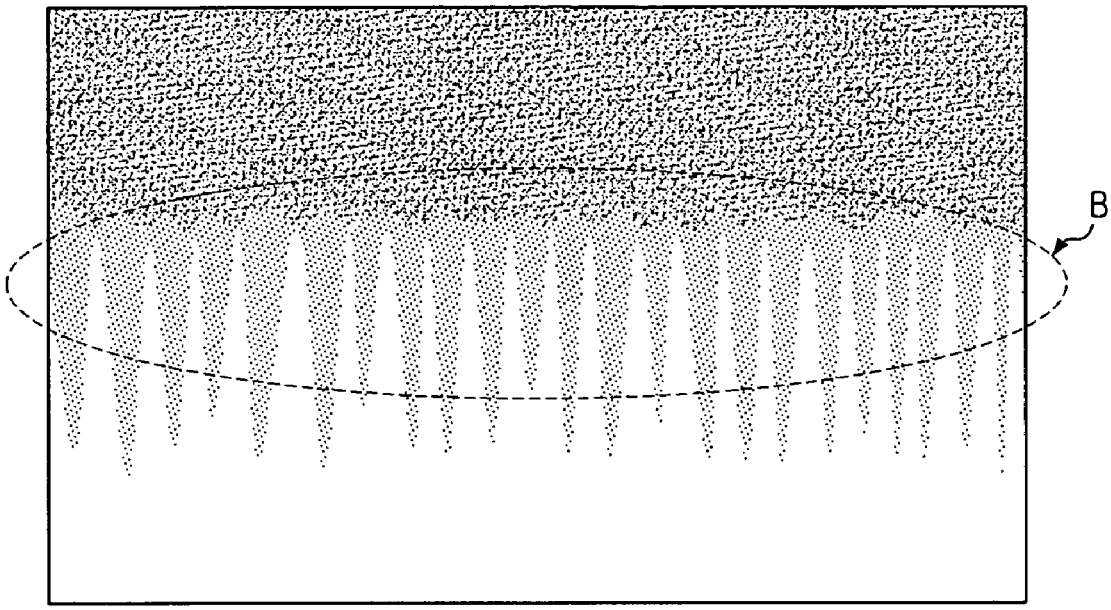
FIG. 2 (PRIOR ART)
FIG. 2 is a picture of a dragged image generated by an image forming apparatus using the belt transfer device of FIG. 1.
Figure 3:
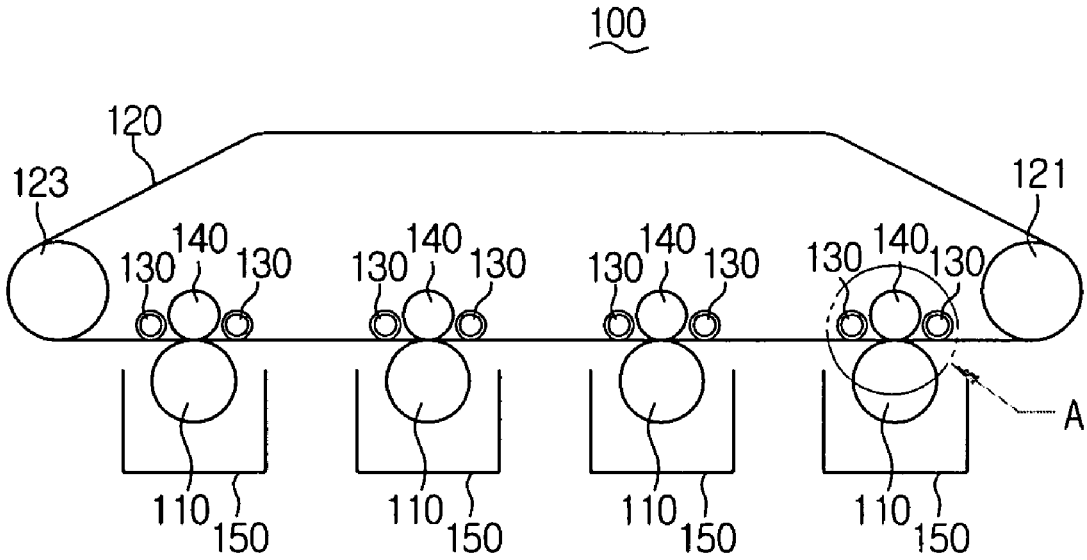
FIG. 3 is a schematic view of a belt transfer device according to an exemplary embodiment of the present invention.
Figure 4:
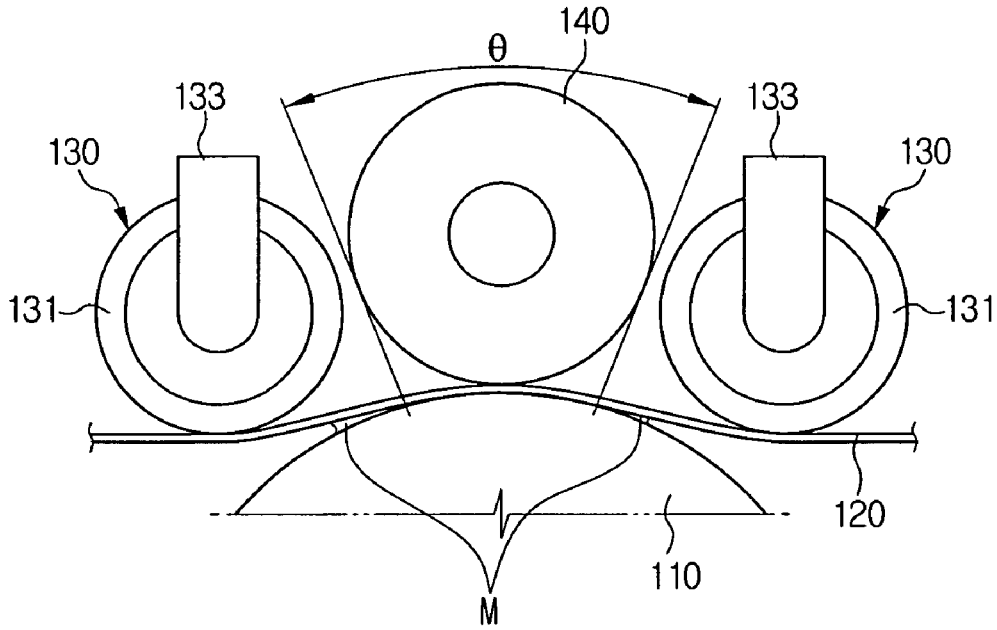
FIG. 4 is an exploded view of the portion of FIG. 3 indicated with an 'A'.

Referring to FIGS. 3 and 4, a belt transfer device 100 according to an exemplary embodiment of the present invention includes a plurality of photosensitive bodies (that is, photosensitive drums) 110, a transfer belt 120, and a plurality of belt pressing members 130.

An electrostatic latent image of printing data is formed on the surface of a photosensitive body 110 by a laser beam which is scanned from an exposing unit (not shown), and the electrostatic latent image is developed to an image of a specific color by a developing unit 150. For a full color image, four photosensitive bodies 110 and four developing units 150 that form images of different colors are aligned along the transfer belt 120.

Figure 9:
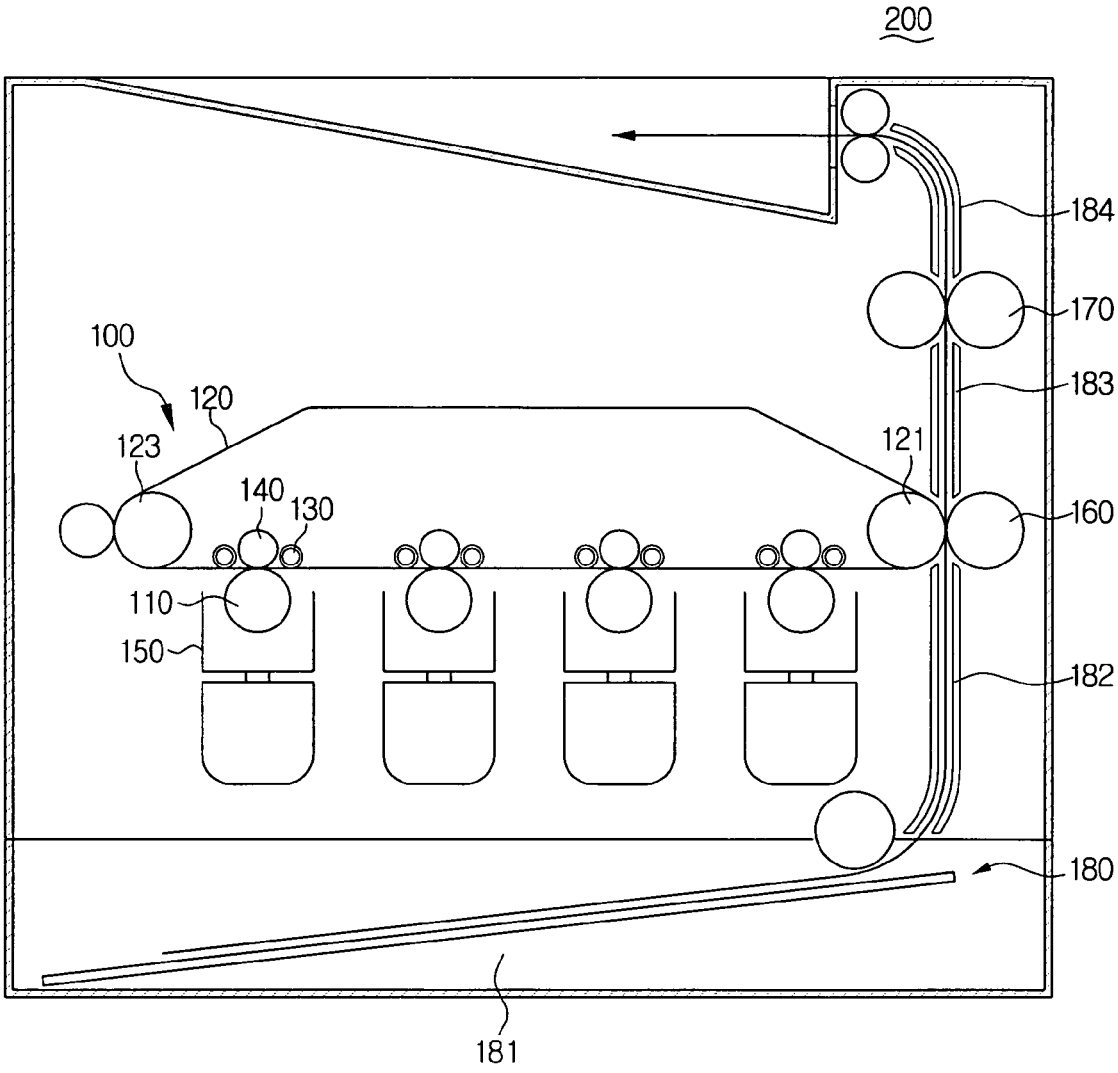
FIG. 9 is a schematic view of an image forming apparatus having a belt transfer device according to an exemplary embodiment of the present invention.

The developed image formed on the surface of the photosensitive body 110 is transferred onto the transfer belt 120, and the transfer belt 120 transfers the image onto a printing medium such as a sheet of paper (see FIG. 9). In this particular exemplary embodiment, images formed on the surfaces of four photosensitive bodies 110 are transferred onto the transfer belt 120 to form a full color image. To make this possible, the transfer belt 120 is installed in such a manner that it follows an endless loop and makes contact with the surfaces of the respective photosensitive bodies 110. As a result, the images formed on the surfaces of the four aligned photosensitive bodies 110 can be transferred onto the endless loop transfer belt 120. The movement of the transfer belt 120 is made possible by two rollers 121, 123. Four transfer rollers 140 are installed on the interior side of the transfer belt 120, more particularly, at each contact point (also called a 'transfer nip') with each photosensitive body 110, thereby facilitating the transfer of the images from the photosensitive bodies 110 to the transfer belt 120.

Figure 5:
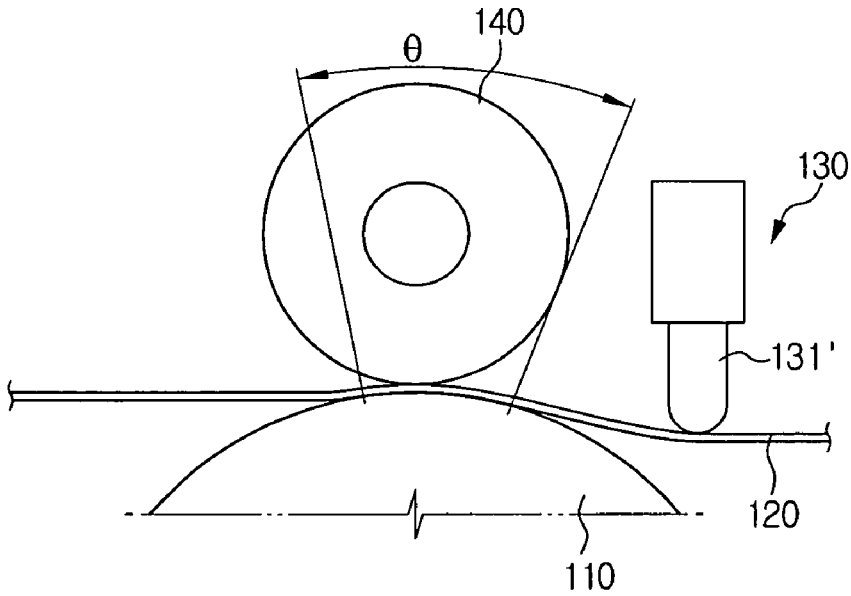
FIG. 5 illustrates another exemplary embodiment of a belt pressing member of FIG. 3.

The belt pressing members 130 press the transfer belt 120 to make sure that the transfer belt 120 follows the endless loop by making contact with the surface of each photosensitive body 110 over a predetermined length. As shown in FIG. 3, two belt pressing members 130 are installed at each transfer nip (for convenience, a transfer nip will be referred to as a 'T1 nip') where the transfer belt 120 comes into contact with the photosensitive bodies 110. That is, two belt pressing members 130 are installed on both sides (in front and behind) of each transfer roller 140 inside the transfer belt 120. As shown in FIG. 4, the belt pressing members 130 includes a guide 131 and a support 133. The guide 131 is installed on the rear surface of the transfer belt 120 and guides the movement of the transfer belt 120 by pushing the transfer belt 120 towards the photosensitive body 110 to make sure that the transfer belt 120 comes into contact with the photosensitive body 110 over a predetermined length. The support 133 is secured to a frame (not shown) where the transfer roller 140 is installed, and ensures that the guide 131 maintains a certain distance from the surface of the photosensitive body 110 during the movement of the transfer belt 120. If the length of the T1 nip between the transfer belt 120 and the photosensitive body 110 changes, for example, because of a change in tension of the transfer belt 120, the support 133 adjusts the position of the guide 131 to modify the length of the T1 nip. The guide 131 can be a guide roller as shown in FIG. 4, a guide rib 131' as shown in FIG. 5, or any other suitable shape, as long as it is able to guide the movement of the transfer belt 120 while pressing the transfer belt 120 into contact with the photosensitive bodies 110. Here, the length of the T1 nip between the transfer belt 120 and each of the photosensitive bodies 110 is carefully set so that the dragging of an image does not occur, especially when the image is transferred from the photosensitive body 110 to the transfer belt 120 by passing through the T1 nip.

In the exemplary embodiment shown in FIG. 4, two belt pressing members 130 are installed in front of and behind the transfer roller 140, respectively. However, only one belt pressing member 130 can be installed either in front of or behind the transfer roller 140, as shown in FIG. 5, if the one belt pressing member 130 can produce an appropriate length of the T1 nip where no dragging of an image occurs.

Preferably, the guides 131 of the belt pressing members 130 are molded using conductive materials (metals or non-metals) so that a voltage can be applied thereto. When a voltage is applied to the belt pressing members 130, the image transfer efficiency from the photosensitive body 110 onto the transfer belt 120 is improved.

The operation of the belt pressing device according to an embodiment of the present invention to prevent the dragging of an image will now be described. Initially, the process involved in the dragging of an image in a wet electrophotographic image forming apparatus will be discussed with reference to FIG. 4. In a T1 transfer process, an image formed on the surface of the photosensitive body 110 passes through a T1 nip, and is transferred onto the transfer belt 120 by an electrical force. There are several parameters that affect the transfer performance of the T1 transfer process, such as, transfer voltage, transfer nip, transfer pressure, and the potential on the developer layer. When the image passes through a T1 nip during the T1 transfer process, the image is subjected to a shear force and/or a drag force by a carrier liquid. Thus, the lower portion of the image is often dragged down into a non-image area. When the transfer belt 120 and the photosensitive body 110 are driven, the carrier liquid in a meniscus M at the T1 nip starts spinning and causes a vortex. The effect of the vortex on the transfer process becomes greater if the length of the T1 nip is short. This is because the image formed on the surface of the photosensitive body 110 enters the meniscus M area of the T1 nip when it is has not yet been transferred completely onto the transfer belt 120. As such, the developer in an image area is dragged down into the non-image area by the shear force of the carrier liquid. This problem can be resolved by increasing the length of the T1 nip. If the T1 nip is long, the image from the photosensitive body 110 is not affected by the carrier liquid at the T1 nip, and can be transferred completely onto the transfer belt 120. The results of tests relating to this effect are shown in FIG. 6 and FIG. 7.

For the test, photosensitive bodies of 30 mm in diameter were used. To change the length of the T1 nip, the transfer belt was pressed by belt pressing members installed on both sides (front and back) of the transfer roller. As the transfer belt was pressed, an angle (θ in FIG. 4, which will be referred to as wrap angle) between the length of the T1 nip and the center of rotation of the photosensitive body was changed. In particular, FIG. 6 is a graph illustrating the relation between the wrap angle (θ) and the length of T1 nip, and FIG. 7 is a graph illustrating the relation between the wrap angle (θ) and the length of dragging.

Figure 6:
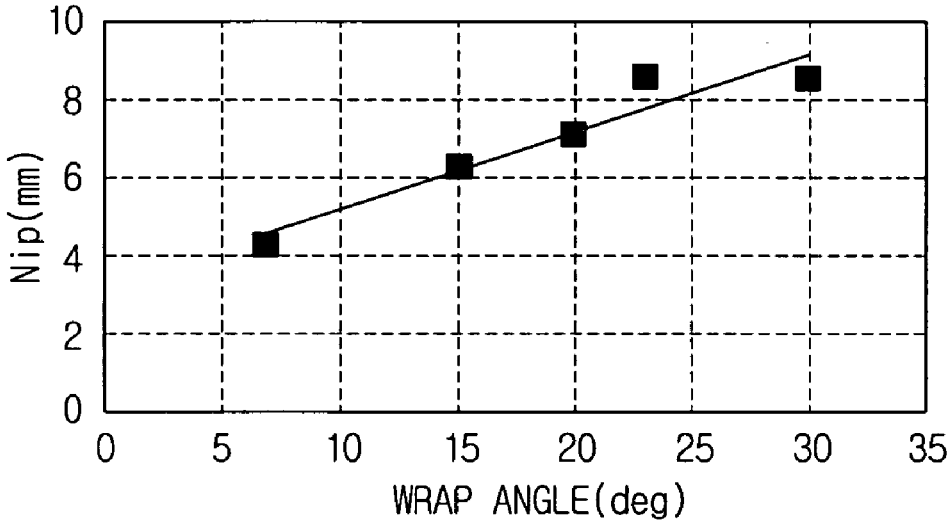
FIG. 6 is a graph illustrating the relationship between the wrap angle and the T1-nip.
Figure 7:
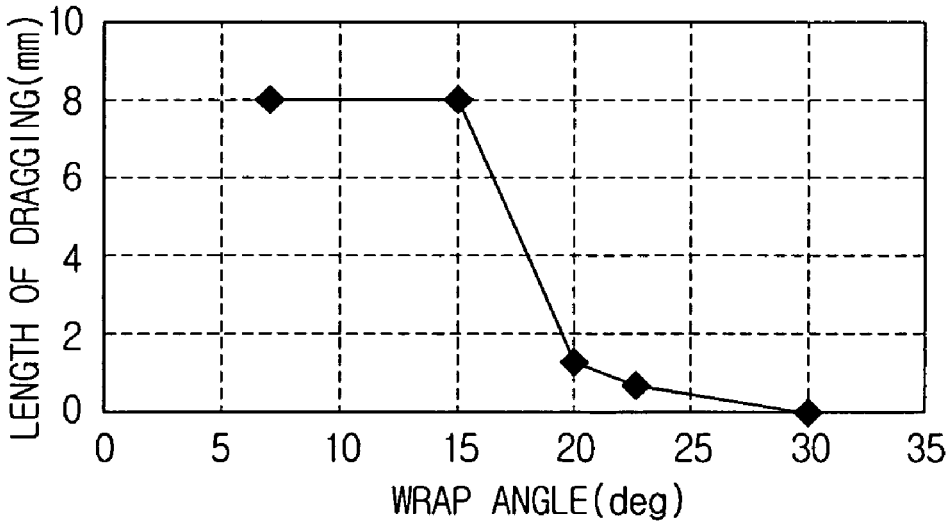
FIG. 7 is a graph illustrating a relation between the wrap angle and the length of dragging.

As can be seen in FIG. 6, the length of a T1 nip is linearly proportional to the wrap angle (θ). On the other hand, the graph in FIG. 7 shows that the dragging of an image is markedly reduced when the wrap angle (θ) is increased, and almost disappears when the wrap angle (θ) becomes greater than 30°. A conclusion can be drawn from the test results that the dragging of an image is reduced as the length of a T1 nip increases, and completely disappears when the length of a T1 nip reaches a certain point. That is, there is a certain value for the length of a T1 nip, in which the dragging of an image does not occur during the T1 transfer process. Therefore, to prevent the dragging of an image, the photosensitive bodies 110 and the transfer belt 120 should be installed in such a manner that the length of T1 nip is greater than the value that prevents dragging. In effect, the length of T1 nip between the photosensitive bodies 110 and the transfer belt 120 can be any value as long as it is greater than the value that prevents dragging. Nevertheless, the upper limit for the length of a T1 nip can be restricted depending on the configuration or arrangement of the photosensitive bodies 110 and the transfer belt 120. For example, if the length of a T1 nip is expressed in terms of a wrap angle (θ), a preferable wrap angle is less than 60° in consideration of the resistance of the photosensitive bodies 110 to the movement of the transfer belt 120.

Figure 8:
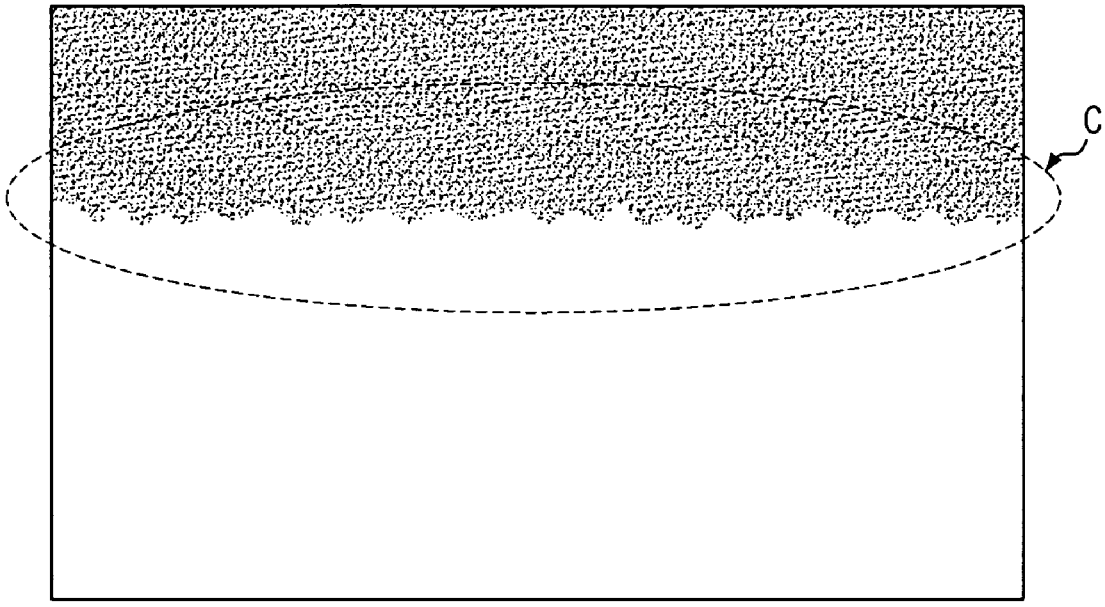
FIG. 8 is a picture of an image with no dragging, that is, an image generated by an image forming apparatus using a belt transfer device according to the exemplary embodiment of the present invention.

In the belt transfer device illustrated in FIG. 4, the belt pressing members 130 are installed so that the wrap angle (θ) with respect to the photosensitive body 110 having the same size as one used in the aforementioned tests is greater than 30°. As such, the image is not dragged when it is transferred from the photosensitive body 110 to the transfer belt 120. FIG. 8 illustrates an image with no dragging, that is, an image obtained using the belt transfer device 100 of the present invention. As shown in FIG. 8, the lower portion (C portion) of the image is not dragged down.

FIG. 9 is a schematic view of an image forming apparatus 200 having the belt transfer device according to the present invention. Referring to FIG. 9, the image forming apparatus 200 includes a belt transfer device 100, a plurality of developing units 150, a fusing unit 170, and a medium feeding unit 180.

The belt transfer device 100 includes a plurality of photosensitive bodies 110, a transfer belt 120, and a plurality of belt pressing members 130 corresponding to the photosensitive bodies 110. An electrostatic latent image of printing data is formed on the surface of the photosensitive body 110 by a laser beam which is scanned from an exposing unit (not shown), and the electrostatic latent image is developed to an image of a specific color by a developing unit 150. For a full color image, four photosensitive bodies 110 and four developing units 150 forming images of different colors are aligned along the transfer belt 120. Here, the photosensitive bodies 110 and the developing units 150 are combined to form combination units, respectively. The image formed on the surface of the photosensitive body 110 is transferred onto the transfer belt 120. Then, the transfer belt 120 transfers the image onto a printing medium, such as a sheet of paper, by means of a second transfer roller 160. In particular, in the present embodiment, images formed on the four photosensitive bodies 110 are transferred onto the transfer belt 120, and form a full color image. The belt pressing members 130 press the transfer belt 120 onto the photosensitive bodies 110 to ensure that the transfer belt 120 follows the endless loop and at the same time makes contact with the surface of each photosensitive body 110 over a certain length, namely, the length of a transfer nip that does not cause dragging of an image during the T1 transfer process. In addition, four transfer rollers 140 are installed on the interior side of the transfer belt 120 to correspond with each of the four photosensitive bodies 110, thereby facilitating the transfer of the images from the photosensitive bodies 110 to the transfer belt 120. The operation of the belt transfer device 100 with the above configuration is the same as before, so a detailed description will not be repeated.

The developing unit 150, using a developing liquid, develops the electrostatic latent image of a printing data that is formed on the surface of the photosensitive body 110 by a laser beam scanned from the exposing unit (not shown), and forms a visible image. In the present embodiment, for example, four developing units 150 of yellow (Y), magenta (M), cyan (C), and black (K) are combined with their corresponding photosensitive bodies 110, and develop the electrostatic latent images formed on the surfaces of the four photosensitive bodies 110 in yellow, magenta, cyan and black colors, respectively.

The fusing unit 170 fuses or fixes the color image that is transferred from the belt transfer device 100 (by means of the second transfer roller 160) onto the printing medium by applying high temperature and pressure.

The medium feeding unit 180 includes a paper feeder 181, a first medium feeder 182, a second medium feeder 183, and a third medium feeder 184. The paper feeder 181 loads printing mediums such as sheets of paper and provides sheets of paper one after another. The first medium feeder 182 feeds a printing medium provided from the paper feeder 181 to the second transfer roller 160 that is used for transferring the color image from the transfer belt 120 onto the printing medium. The second medium feeder 183 feeds the printing medium bearing the color image transferred through the second transfer roller 160 to the fusing unit 170. The third medium feeder 184 discharges the printing medium with the fused image.

The operation of the image forming apparatus 200 according to an exemplary embodiment of the present invention will now be described. When a controller (not shown) receives a print signal and print data from a computer, for example, the controller controls the exposing unit (not shown) to form an electrostatic latent image of the print data on each surface of the four photosensitive bodies 110, respectively, and then controls the developing unit 150 to develop the electrostatic latent images formed on the surfaces of the four photosensitive bodies 110 into visible images of different colors. Later, the images formed on the photosensitive bodies 110 are transferred and superimposed onto the surface of the transfer belt 120, and form a full color image. The length of the T1 nip where the rotating transfer belt 120 makes contact with each of the photosensitive bodies 110 is greater than the length required to form an image without dragging. Consequently, dragging does not occur during the T1 transfer process in which the images on the respective photosensitive bodies 110 are transferred onto the transfer belt 120.

The transferred color image formed on the surface of the transfer belt 120 from the photosensitive bodies 110 is transferred onto a printing medium that is fed between the second transfer roller 160 and the transfer belt 120. The printing medium is sent to the fusing unit 170 by the second medium feeder 183 to fuse the color image onto the printing medium, and eventually discharged outside the apparatus by the third medium feeder 184.

The transfer belt device of the present invention advantageously prevents the dragging of an image during the T1 transfer process. Therefore, as shown in FIG. 8, the printed image on the released paper is also sharp and clear, having no dragged portion.

While the invention has been shown and described with reference to certain embodiments thereof, it will be understood by those skilled in the art that various changes in form and details may be made therein without departing from the spirit and scope of the invention as defined by the appended claims.

What is claimed is:

1. A belt transfer device comprising:

a transfer belt following an endless loop in contact with a photosensitive body; and at least one belt pressing member for pressing the transfer belt to increase the length of a transfer nip between the photosensitive body and the transfer belt;

wherein the at least one belt pressing member does not press the photosensitive body with the transfer belt interposed therebetween; and the length of the transfer nip corresponds to a wrap angle between approximately 30 and 60 degrees.

2. The belt transfer device according to claim 1, wherein the length of the transfer nip between the photosensitive body and the transfer belt is greater than a value at which dragging of an image does not occur during a transfer process for transferring an image from the photosensitive body onto the transfer belt.

3. The belt transfer device according to claim 1, further comprising:

a transfer roller opposed to the photosensitive body, the at least one belt pressing member being installed in front of or behind the transfer roller.

4. The belt transfer device according to claim 1, wherein the at least one belt pressing member is a guide roller.

5. The belt transfer device according to claim 1, wherein the at least one belt pressing member is formed of conductive materials.

6. A belt transfer device comprising:

a transfer belt following an endless loop in contact with a photosensitive body; and at least one belt pressing member for pressing the transfer belt to increase the length of a transfer nip between the photosensitive body and the transfer belt;

wherein the at least one belt pressing member is a guide rib.

7. An image forming apparatus, comprising:

a plurality of photosensitive bodies for having electrostatic latent images formed thereon;

a plurality of developing units for developing the electrostatic latent images formed on the photosensitive bodies;

a transfer belt following an endless loop in contact with the photosensitive bodies to allow the images on the photosensitive bodies to be transferred onto the transfer belt;

a plurality of transfer rollers disposed opposite to the photosensitive bodies; and a plurality of belt pressing members installed in front of and/or behind the transfer rollers for pressing the transfer belt to increase the length of a transfer nip between each of the photosensitive bodies and the transfer belt;

wherein the belt pressing members comprise guide ribs.

8. The image forming apparatus according to claim 7, wherein the photosensitive bodies and the developing units are combined.

9. The image forming apparatus according to claim 7, wherein the belt pressing members are guide rollers.

10. The image forming apparatus according to claim 7, wherein the belt pressing members are formed of conductive materials.

11. An image forming apparatus, comprising:

a photosensitive body;

a developing unit corresponding to the photosensitive body, the developing unit developing electrostatic latent images formed on the photosensitive body;

a transfer belt that contacts the photosensitive body to allow developed images on the photosensitive body to be transferred onto the transfer belt;

a transfer roller disposed opposite to the photosensitive body; and at least one belt pressing member installed proximate to the transfer roller to increase the length of a transfer nip between the photosensitive body and the transfer belt;

wherein the at least one belt pressing member does not press the photosensitive body with the transfer belt interposed therebetween; and the length of the transfer nip corresponds to a wrap angle between approximately 30 and 60 degrees.

12. The image forming apparatus according to claim 11, wherein the at least one belt pressing member is a guide roller.

13. The image forming apparatus according to claim 11, wherein the at least one belt pressing member comprises:

a guide roller located in front of the transfer nip; and a guide roller located behind the transfer nip.

14. An image forming apparatus, comprising:

a photosensitive body;

a developing unit corresponding to the photosensitive body, the developing unit developing electrostatic latent images formed on the photosensitive body;

a transfer belt that contacts the photosensitive body to allow developed images on the photosensitive body to be transferred onto the transfer belt;

a transfer roller disposed opposite to the photosensitive body; and at least one belt pressing member installed proximate to the transfer roller to increase the length of a transfer nip between the photosensitive body and the transfer belt;

wherein the at least one belt pressing member comprises a guide rib.

15. An image forming apparatus, comprising:

a photosensitive body;

a developing unit corresponding to the photosensitive body, the developing unit developing electrostatic latent images formed on the photosensitive body;

a transfer belt that contacts the photosensitive body to allow developed images on the photosensitive body to be transferred onto the transfer belt;

a transfer roller disposed opposite to the photosensitive body; and at least one belt pressing member installed proximate to the transfer roller to increase the length of a transfer nip between the photosensitive body and the transfer belt;

wherein the at least one belt pressing member comprises:

a guide rib located in front of the transfer nip; and a guide rib located behind the transfer nip.

16. The image forming apparatus according to claim 15, wherein the length of the transfer nip corresponds to a wrap angle between approximately 30 and 60 degrees.

* * * * *